United States Patent [19]

Hentschel

[11] 3,970,243

[45] July 20, 1976

[54] SUPPORT STRUCTURE FOR A SUSPENSION CENTRIFUGE

[75] Inventor: Volkmar Hentschel, Braunschweig, Germany

[73] Assignee: Braunschweigische Maschinenbauanstalt, Braunschweig, Germany

[22] Filed: July 15, 1975

[21] Appl. No.: 596,181

[30] Foreign Application Priority Data

July 25, 1974 Germany ..... 2435733

[52] U.S. Cl. ..... 233/19 R; 233/1 A; 233/1 B

[51] Int. Cl.[2] ..... B04B 11/00

[58] Field of Search ..... 233/1 R, 1 A, 19 R, 233/20 R, 20 A, 23 R, 24, 27, 1 B; 127/19

[56] References Cited

UNITED STATES PATENTS 3,497,385 2/1970 Steele et al. ..... 233/19 R

FOREIGN PATENTS OR APPLICATIONS

| | | | |
|---|---|---|---|
| 1,002,691 | 2/1957 | Germany | 233/1 R |
| 1,007,701 | 5/1957 | Germany | 233/1 R |
| 928,810 | 6/1963 | United Kingdom | 233/1 R |

*Primary Examiner*—George H. Krizmanich
*Attorney, Agent, or Firm*—W. G. Fasse; W. W. Roberts

[57] ABSTRACT

A support structure for a suspension centrifuge includes pressure responsive means for automatically monitoring and stopping the loading or filling of the centrifuge in response to a certain, if desired, adjustable pressure. For this purpose, the axial bearing is supported with its outer race by a piston ring which reaches into a ring groove or cylinder in a support ring. The ring groove contains a pressure medium and communicates with a pressure responsive switch means which is connected to control, for example, a filling valve for the centrifuge.

9 Claims, 2 Drawing Figures

SUPPORT STRUCTURE FOR A SUSPENSION CENTRIFUGE

BACKGROUND OF THE INVENTION

The present invention relates to a support structure for a suspension centrifuge, more specifically to such a centrifuge adapted for an intermittent operation, especially in the sugar industry. Such a centrifuge is equipped with a device for the automatic monitoring of the filling operation of the centrifuge. The centrifuge shaft is rotatably supported by radial and axial bearing means spaced from each other and held in a so called ball head arrangement.

Suspension centrifuges of different types are known in the art comprising devices for the determination or monitoring of the filling operation. Generally, such monitoring of the filling is accomplished by continuously measuring the weight increase of the centrifuge drum as the massecuite flows into the drum. When a predetermined weight value is reached, the flow of massecuite is shut off. For this purpose a centrifuge as disclosed in German Pat. No. 1,002,691 has been supported, in a manner varying from the manner described above so that the centrifuge is capable of making only vertical movements, whereby the vertical movement depends on the weight of the load of the centrifuge. The vertical movement is sensed by or supplied to an electrical or pneumatic switching member by means of an elastic plate. The switching member in turn controls the filling elements of the centrifuge such as a valve controlling the massecuite flow. The available vertical movements result only in very small deflections of said elastic plate which thus may cause an erroneous shut off. Thus, German Pat. No. 1,007,701 discloses an improved version of the centrifuge described above. In the improved version the deflection of the elastic plate is translated by lever means to provide an enlarged movement in response to the vertical displacement of the centrifuge. The enlarged movement is then used for actuating the switching means for the massecuite supply device.

With the just described devices it is relatively difficult to ascertain precisely the filling weight of a centrifuge. Thus, German Pat. No. 1,101,295 describes a further development in which the centrifuge drum is longitudinally displaceable along its rotational shaft and the relative variation of the centrifuge drum position relative to the drum shaft or relative to an adjustable reference point is employed for determining the filling weight of the centrifuge drum. In this prior art arrangement of the centrifuge the longitudinal displacement of the drum relative to the rotational shaft of the drum is accomplished by means of a guide bushing, which supports the drum, whereby the drum is additionally supported by a spring including a dumping mechanism. The dumping mechanism comprises a piston cylinder arrangement including throttling openings in the piston.

The just described centrifuge structure has the disadvantage that oscillatory motions of the drum on its shaft cannot be avoided. It is not possible to adjust the dumping mechanism of this arrangement in such a manner that the oscillatory movements are completely avoided. Such an adjustment is not possible, because it would falsify the weight measuring results, because the increased dampening causes a delay of the longitudinal movement of the centrifuge drum relative to the shaft.

As a result, the relative position of the centrifuge drum on its shaft deviates more and more from the value which represents the weight of the massecuite if no dampening were employed at all. Furthermore, the known arrangement is rather expensive due to the structural elements required for accommodating the axial displacement of the centrifuge drum relative to its rotational shaft. These elements also make the arrangement trouble prone. In addition, it is practically not possible to employ the prior art arrangement in connection with larger drums having, for example, a filling capacity of about 1,000 kgs or more. The realization of the vertical drum displacement along its rotational shaft becomes more and more difficult with increasing filling capacities due to the forces which must be transmitted from the rotational shaft to the centrifuge drum.

OBJECTS OF THE INVENTION

In view of the foregoing, it is the aim of the invention to achieve the following objects singly or in combination:

to overcome the above described difficulties of the prior art, more specifically to provide an accurate control of the filling operation of a suspension centrifuge;

to construct a suspension centrifuge in such a manner that the device for the automatic monitoring of the filling operation of the centrifuge drum is arranged in a protected manner while simultaneously requiring a minimum of structural elements to reduce the costs of the drum;

to provide a support structure which will permit an accurate and precise measuring of the weight of the drum as it increases when the drum is being filled, even if the drum has a large filling capacity;

to provide a measuring device for the weight of the drum which will achieve accurate measurements even if the massecuites are of a type which has poor flow characteristics, and which is not sensitive relative to overloads and vibrations of the centrifuge;

to provide a support structure for a suspension centrifuge which will permit pivotal movements of the centrifuge and not merely axial displacements;

to integrate the weight monitoring means of a suspension centrifuge into the support structure in such a manner that the weight increase as the drum is being filled, may be continuously ascertained and that upon reaching of a specific predetermined weight, the filling may be stopped; and to arrange the weight measuring means inside the support structure in such a manner that the measuring means are protected against dirt and corrosion.

SUMMARY OF THE INVENTION

According to the invention there is provided a support structure for a suspension centrifuge comprising a rotational shaft supported by means of a ball head in a ball socket. The shaft is supported in the ball head by means of an axial bearing and a radial bearing and the centrifuge proper is suspended from the shaft. The axial bearing has an outer race secured against rotation and a ring piston supports the outer race relative to a ring cylinder, whereby both surround the rotational shaft. The free end of the ring piston reaches into a ring groove in the ring cylinder, which contains a pressure fluid, and which is connected to a pressure responsive actuating means such as a pressure gauge including a pressure responsive switch means. The supporting ring cylinder or supporting ring is secured in the ball head against axial displacement.

Due to the suspending of the centrifuge shaft by means of a ball head in a ball socket, the entire centrifuge is capable of pivotal or vibrational movements. Supporting the axial bearing, or more specifically the outer race of the axial bearing by means of a piston cylinder arrangement has the advantage that the supporting ring, which is required in any event, is employed to form the ring cylinder for the ring piston. The pressure fluid in the ring groove in the support ring or cylinder is non-compressible for all practical purposes and the pressure in the cylinder space may be measured without any substantial outflow of pressure fluid from the support ring cylinder. Thus, it is possible to continuously measure the weight increase of the drum suspended by the rotational shaft. Further, it is possible to actuate a switching means in response to the reaching of predetermined rated values, for example, when the quantity of massecuite filled into the drum reaches a certain weight. In view of the foregoing, it will be appreciated that the arrangement according to the invention does not primarily constitute a dampening mechanism, but rather a pressure measuring device cooperating with the pressure fluid in the ring cylinder. A further advantage of the invention is seen in that by arranging the elements in the ball head as taught herein, the elements are protected against dirt and corrosion.

BRIEF FIGURE DESCRIPTION

In order that the invention may be clearly understood, it will now be described, by way of example, with reference to the accompanying drawings, wherein:

FIG. 1 is an axial sectional view of the supporting structure according to the invention; and FIG. 2 is a view similar to that of FIG. 1, but showing a modification of the pressure responsive or exerting means.

DETAILED DESCRIPTION OF EXAMPLE EMBODIMENTS

Figure 1:
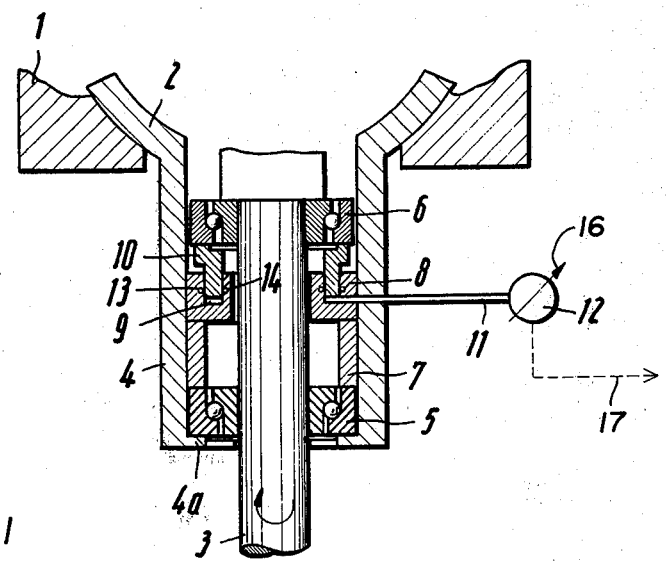

The axial, sectional view of the support structure according to the invention shown in FIG. 1 comprises a centrifuge shaft 3 to the lower end of which there is secured, by well known means, a centrifuge drum not shown. A ball socket 1 is secured to a frame or foundation structure not shown, since it does not form part of the invention. A ball head 2 is supported in the ball socket 1 for pivotal movement. Due to the just described arrangement, the centrifuge drum, which is rigidly secured to the lower end of the rotational shaft 3 is capable of performing movements in the manner of a pendulum, for example, in response to unbalance conditions forcing the centrifuge out of its vertical position. Such unbalance conditions may occur for example, as a result of an uneven flow of the massecuite.

The means for securing the shaft 3 in the ball head 2 comprise, for example a bushing 4 extending downwardly from the ball head 2 toward the centrifuge drum and forming an integral portion of the ball head 2. The bushing 4 surrounds the shaft 3 and has a lower shoulder or flange **4*a* to hold the radial bearing 5 as well as the axial bearing 6, which are spaced from each other. A spacer bushing 7 is arranged between the radial bearing 5 and the support ring 8 which in turn supports the outer race of the axial bearing 6. The support ring 8 also surrounds the shaft 3** with some play.

According to the invention the support ring 8 is provided with a ring groove 9 surrounding concentrically the centrifuge shaft 3 and thus forming a ring cylinder for a ring piston 10, the upper end of which is rigidly secured to the outer race of the axial bearing 6, and the lower end of which reaches into the ring groove 9 to form a piston therein. The outer race of the axial bearing 6 is secured against rotation. The ring cylinder or rather the ring groove 9 contains a pressure fluid and is connected through a pressure conduit 11 to a pressure responsive actuating means 12, which may, for example, be a pressure gauge comprising pressure responsive switch means known as such, and which also may be provided with pressure indicating means 16. The pressure responsive switch means are preferably adjustable to respond to a certain pre-selected pressure for closing electrical circuit means 17 to thereby, for example, close the valve of a massecuite supply or filling device.

Sealing means are provided between the ring piston 10 and the inner walls of the ring groove 9 forming a cylinder space in the supporting ring 8. Said sealing means may, for example, be provided in the form of O-rings 13 and 14.

Figure 2:
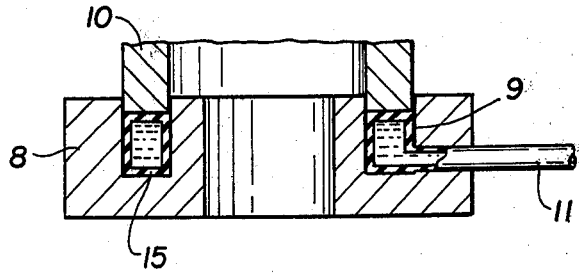

FIG. 2 shows a view similar to that of FIG. 1, however, a hollow ring member 15 of elastic material is arranged in the ring groove 9 of the support ring 8. The hollow ring member 15 contains the pressure fluid and is connected through the conduit 11 to the pressure responsive actuating means to communicate the pressure created by the ring piston 10 to the pressure responsive actuating means.

In operation, when the centrifuge drum is filled with massecuite, the ring piston 10 will exert increasing pressure on the fluid in the ring groove 9 in response to the increasing weight of the drum. The increased pressure is thus indicated by the pressure gauge 12 and when a predetermined pressure has been reached, the pressure responsive switch means are operated in a manner known as such. As mentioned, the closing of a switch may, for example, actuate a relay or solenoid which in turn will close a valve in the massecuite supply line. The same applies to the operation of FIG. 2, since the hollow ring member, for example of rubber, transmits the pressure increase to the fluid.

In both embodiments, the elements are securely arranged inside the ball head 2 or inside the extension bushing 4 of the ball heads 2 whereby the elements are protected against dirt and corrosion. The arrangement with the sleeve 4 forming an integral part of the ball head 2 has the advantage that the supporting structure is easily assembled. However, it will be appreciated that the supporting structure may also be arranged inside the ball head, thereby obviating the extension bushing 4. However, the use of such an extension bushing 4 substantially simplifies the production and assembly procedure.

Incidentally, the arrangement of the O-rings 13 and 14 is advisable when the ring groove 9 is directly filled with the pressure fluid, such as oil. However, where a pressure fluid containing ring member 15 is employed, it will not be necessary to use the sealing O-rings, whereby, as mentioned, the hollow ring member 15 is directly connected to the pressure responsive actuating means, such as a pressure gauge including a pressure responsive switch, the responsiveness of which is adjustable.

Although the invention has been described with reference to specific example embodiments, it is to be understood, that it is intended to cover all modifications and equivalents within the scope of the appended claims.

What is claimed is:

1. A support structure for a suspension centrifuge comprising rotational shaft means for suspending said centrifuge, ball socket means, ball head means supported for pivotal movement in said ball socket means, shaft bearing means operatively supported by said ball head means, said shaft bearing means comprising axial bearing means and radial bearing means, said axial bearing means including an outer race and an inner race, said bearing means further comprising support ring means held against axial displacement by said ball head means to surround with play said rotational shaft means, a ring groove in said support ring means facing toward said axial bearing means, ring piston means rigidly secured at one end thereof to said outer race of said axial bearing means, and surrounding said rotational shaft means to reach with its other piston end into said ring groove, pressure fluid in said ring groove, pressure responsive actuating means, and conduit means operatively connecting said pressure responsive actuating means to said pressure fluid in said ring groove, whereby said pressure responsive actuating means may monitor the filling of said centrifuge.

2. The support structure according to claim 1, wherein said ball head means comprise a bearing pivot ball and a bushing secured to said bearing pivot ball to surround said rotational shaft of the centrifuge, said radial bearing means, said axial bearing means, said support ring means and said ring piston means being arranged inside said bushing.

3. The support structure according to claim 1, further comprising sealing means arranged between said ring piston means and said support ring means in the ring groove thereof.

4. The support structure according to claim 3, wherein said sealing means comprise O-ring means.

5. The support structure according to claim 1, further comprising a hollow ring member located in said ring groove and made of elastically yielding material, said hollow ring member containing said pressure fluid, said conduit means providing fluid communication between said hollow ring member and said pressure responsive actuating means.

6. The support structure according to claim 5, wherein said pressure responsive actuating means also comprise pressure indicating means.

7. The support structure according to claim 5, wherein said pressure responsive actuating means comprise a pressure gauge including switch means, the pressure responsiveness of which is adjustable.

8. The support structure according to claim 1, wherein said outer race of said axial bearing means is secured against rotation.

9. The support structure according to claim 1, further comprising a spacer member arranged to surround said rotational shaft between said radial bearing means and said support ring means.

* * * * *